US010435875B2

(12) United States Patent
Kimberley et al.

(10) Patent No.: US 10,435,875 B2
(45) Date of Patent: Oct. 8, 2019

(54) DEBRIS TRAP

(71) Applicants: Bruce Kimberley, Hornsby (AU); Ian Kimberley, Hornsby (AU)

(72) Inventors: Bruce Kimberley, Hornsby (AU); Ian Kimberley, Hornsby (AU)

( * ) Notice: Subject to any disclaimer, the term of this patent is extended or adjusted under 35 U.S.C. 154(b) by 97 days.

(21) Appl. No.: 15/320,018

(22) PCT Filed: Jun. 17, 2015

(86) PCT No.: PCT/AU2015/050332

§ 371 (c)(1),
(2) Date: Dec. 19, 2016

(87) PCT Pub. No.: WO2015/196248

PCT Pub. Date: Dec. 30, 2015

(65) Prior Publication Data

US 2017/0130434 A1 May 11, 2017

(30) Foreign Application Priority Data

Jun. 23, 2014 (AU) ..... 2014902394

(51) Int. Cl.
*E03C 1/26* (2006.01)
*E03C 1/264* (2006.01)
*E03F 5/06* (2006.01)

(52) U.S. Cl.
CPC ..... *E03C 1/26* (2013.01); *E03C 1/264* (2013.01); *E03F 5/06* (2013.01)

(58) Field of Classification Search
None
See application file for complete search history.

(56) References Cited

U.S. PATENT DOCUMENTS 3,372,807 A * 3/1968 Barnard ..... F01P 11/06 210/198.1
3,465,885 A * 9/1969 Trump ..... E04D 13/08 210/447
4,164,048 A * 8/1979 Kampfer ..... E03C 1/282 137/247.41
5,230,798 A 7/1993 Rogman
(Continued)

FOREIGN PATENT DOCUMENTS

AU 2009200625 A1 12/2009
GB 2 288 340 A 10/1995
GB 2 358 886 A 8/2001

OTHER PUBLICATIONS

International Search Report Corresponding to PCT/AU2015/050332 dated Aug. 31, 2015.
(Continued)

*Primary Examiner* — Benjamin M Kurtz
(74) *Attorney, Agent, or Firm* — Davis & Bujold PLLC; Michael J. Bujold

(57) ABSTRACT

Debris traps are described including a housing, the housing including an inlet and an outlet and a fluid flow passage extending from the inlet to the outlet. The housing further including an inspection opening and an inspection cover which is removable to allow access to the fluid flow passage. A debris trapping device is arranged to lie across the fluid flow passage and the debris trapping device may be introduced to, or withdrawn from, the housing through the inspection opening.

10 Claims, 8 Drawing Sheets

(56) References Cited

U.S. PATENT DOCUMENTS

| | | | | |
|---|---|---|---|---|
| 5,985,158 | A | 11/1999 | Tiderington | |
| 7,919,002 | B1 | 4/2011 | Hurtado | |
| 2004/0144703 | A1 | 7/2004 | Davenport | |
| 2008/0184484 | A1 * | 8/2008 | Webster | E03C 1/26 4/679 |

OTHER PUBLICATIONS

Written Opinion Corresponding to PCT/AU2015/050332 dated Aug. 31, 2015.

* cited by examiner

DEBRIS TRAP

TECHNICAL FIELD

The present invention relates to debris traps which are intended for use during construction of buildings and to methods of installing pipework in buildings.

BACKGROUND TO THE INVENTION

During the construction of a building, sewerage and stormwater pipe installations are left open. Because of this, concrete, building debris, rags and builders tools often inadvertently fall down the open pipes and block the pipes which can block water flow throughout the entire building. This can lead to later flooding of the building causing damage to carpet and timber and also necessitates remedial work to remove blockages from the pipes.

SUMMARY OF THE INVENTION

In a first aspect the present invention provides a debris trap including: a housing, the housing including an inlet and an outlet and a fluid flow passage extending from the inlet to the outlet; the housing further including an inspection opening and an inspection cover which is removable to allow access to the fluid flow passage; a debris trapping device which is arranged to lie across the fluid flow passage; the debris trapping device may be introduced to, or withdrawn from, the housing through the inspection opening.

The inspection cover may include a transparent portion.

The debris trap may include a fluid bypass pathway which allows fluid to bypass the debris trapping device.

The debris trapping device may define at least a portion of the fluid bypass pathway.

The debris trapping device may include a stem portion which cooperates with the housing to define the fluid bypass pathway.

The debris trapping device may include a handle portion.

The handle portion may locate against the inner face of the inspection cover.

There may be a space in the region of the inspection cover and the debris trapping portion may be angled to guide trapped debris into the space.

In a second aspect the present invention provides a debris trapping device including: a debris trapping portion which is arranged to lie across a fluid flow passage, the debris trapping portion including apertures to allow fluid to flow through the device; a handle portion to allow the device to be grasped to introduce or remove the device from the passage.

In a third aspect the present invention provides a method of installing pipework in a building including the steps of: installing one or more debris trapping devices in the pipework during construction of the pipework; and removing the one or more debris trapping devices after the construction of the pipework is completed.

BRIEF DESCRIPTION OF THE DRAWINGS

Embodiments of the present invention will now be described, by way of example only, with reference to the accompanying drawings, in which.

DETAILED DESCRIPTION OF THE PREFERRED EMBODIMENT

Figure 1:
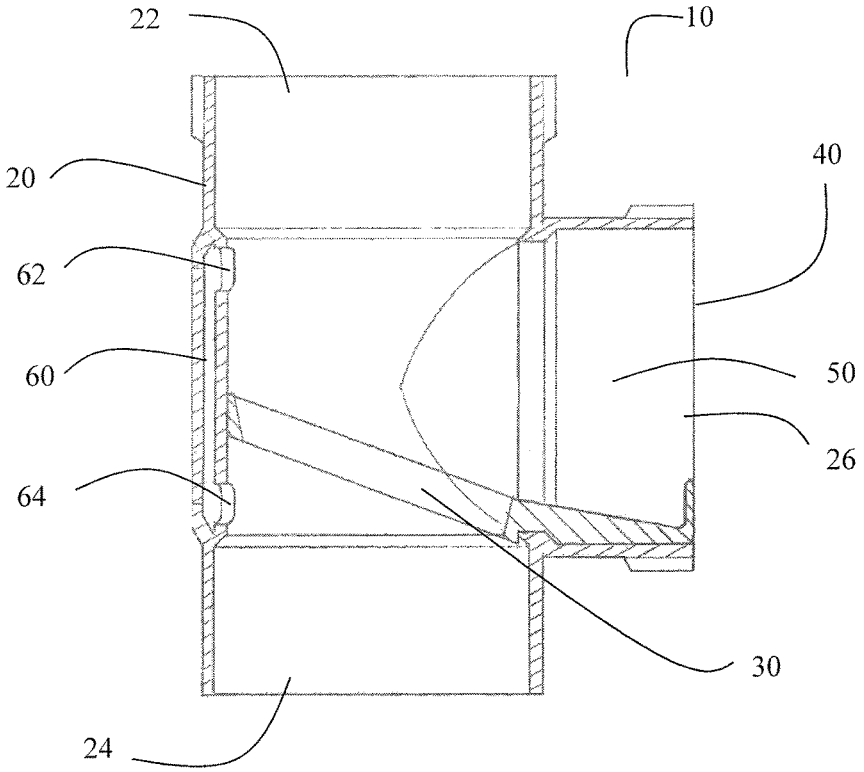
FIG. 1 is a side cross sectional view of a debris trap according to an embodiment of the invention.
Figure 2:
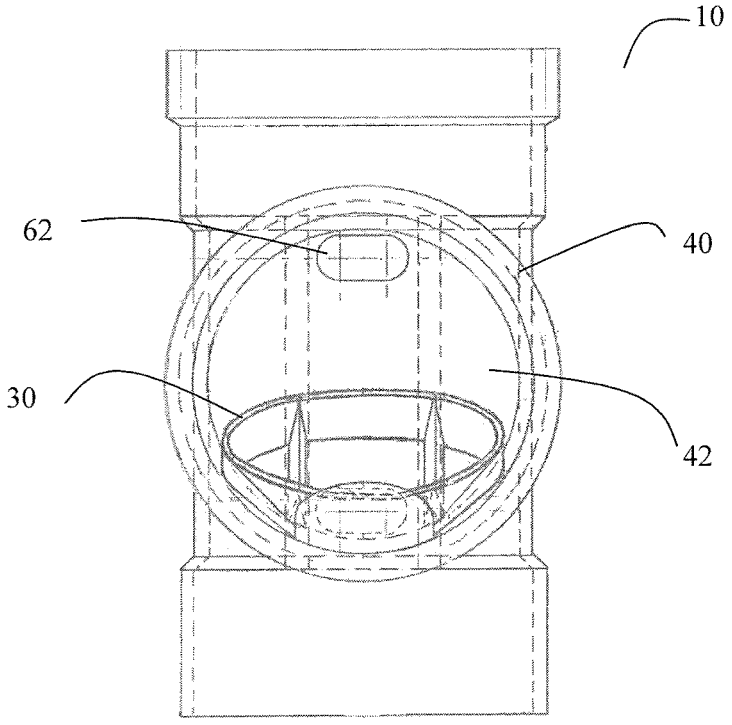
FIG. 2 is a front view of the debris trap of FIG. 1.
Figure 3:
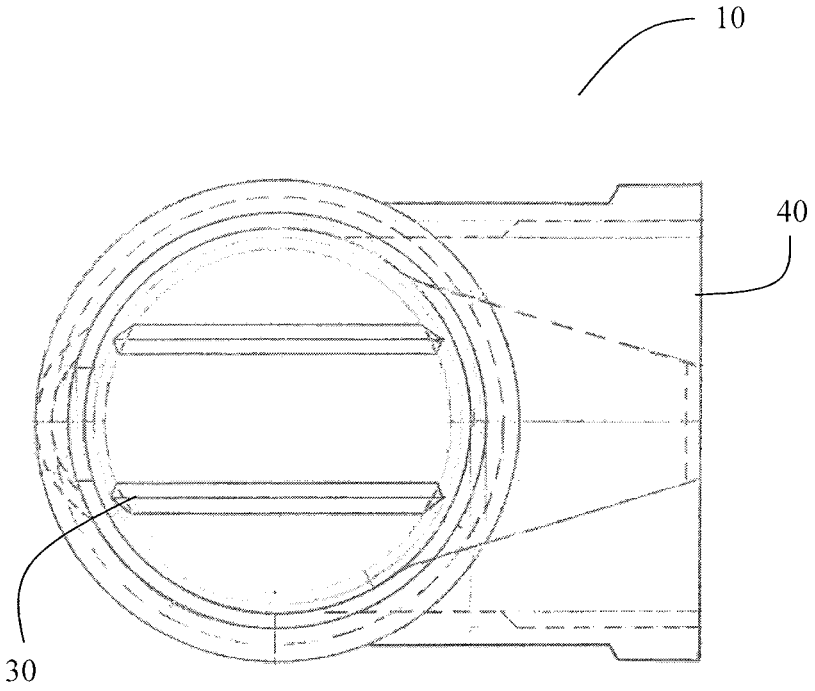
FIG. 3 is a top view of the debris trap of FIG. 1.

Referring to FIGS. 1 to 3, a debris trap 10 is shown including a housing which is generally in the form of a pipe DWV Boss Junction/Inspection Tee 20 and includes an inlet 22, an outlet 24 and an inspection opening 26. The housing 20 is hollow to provide a fluid flow passage extending from the inlet 22 to the outlet 24, and also joining with the inspection opening 26. Each of the inlet 22 and outlet 24 are provided with external threaded portions to allow removable watertight fitting to adjacent pipework.

A debris trapping device in the form of a removable grate 30 is positioned inside the housing 20 and extends across the fluid flow passage. An inspection cover 40 is screw fitted to the inspection opening 26. The grate 30 may be removed from, and inserted into, the housing through the inspection opening 26 when the inspection cover 40 is removed.

Figure 4:
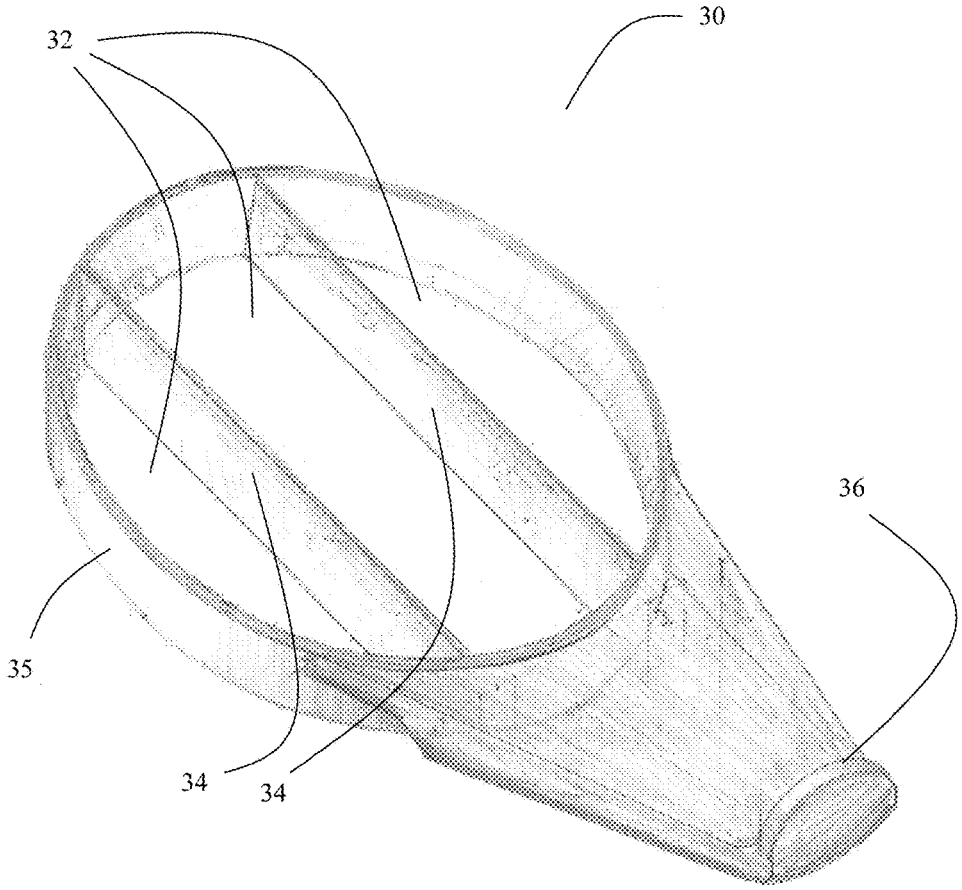
FIG. 4 is a perspective view of the grate of the debris trap of FIG. 1.
Figure 5:
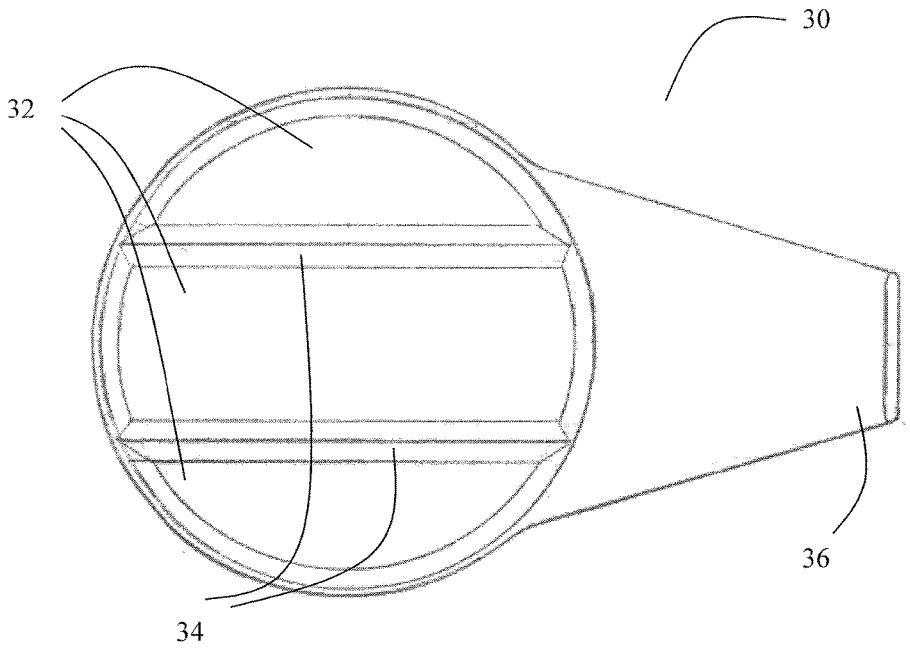
FIG. 5 is a top view of the grate of FIG. 4.
Figure 6:
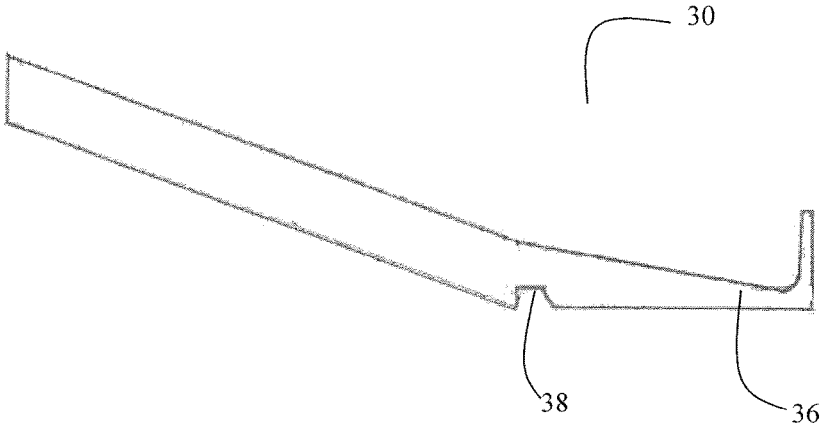
FIG. 6 is a side view of the grate of FIG. 1.

Referring to FIGS. 4 to 6, the grate 30 includes two bars 34 which define apertures 32 in the grate. Grate 30 also includes a handle portion 36 which allows the grate to be grasped and manipulated. In use, fluid can pass through the apertures 32 in the grate. Debris which is larger than the apertures is trapped by the bars 34 of the grate.

The bars 34 of the grate are angled upwardly by approximately 20 degrees. The outer face 35 of the grate has a cylindrical profile which is also angled in a similar fashion to the bars 34 so that the outer face 35 of the grate 30 conforms to the cylindrical walls of the inside of the housing. The grate 30 is retained in position in the housing by way of recess 38 which sits over a lip in the housing. Furthermore, the outside face of the handle portion lies against the inside face of the inspection cover 40 which also serves to retain the grate 30 in position.

The angle of the bars 34 of the grate 30 assists in guiding any trapped debris into the space 50 behind the inspection cover 40. The inspection cover includes a transparent portion 42 which allows a visual inspection to be made to determine if any debris is in the debris trap. If so, debris can be removed by removing the inspection cover 40.

Referring again to FIG. 1, housing 20 includes fluid bypass pathway 60 with an inlet 62 and an outlet 64. This allows fluid to bypass the grate 30 in the event that the grate becomes completely blocked with debris.

Figure 7:
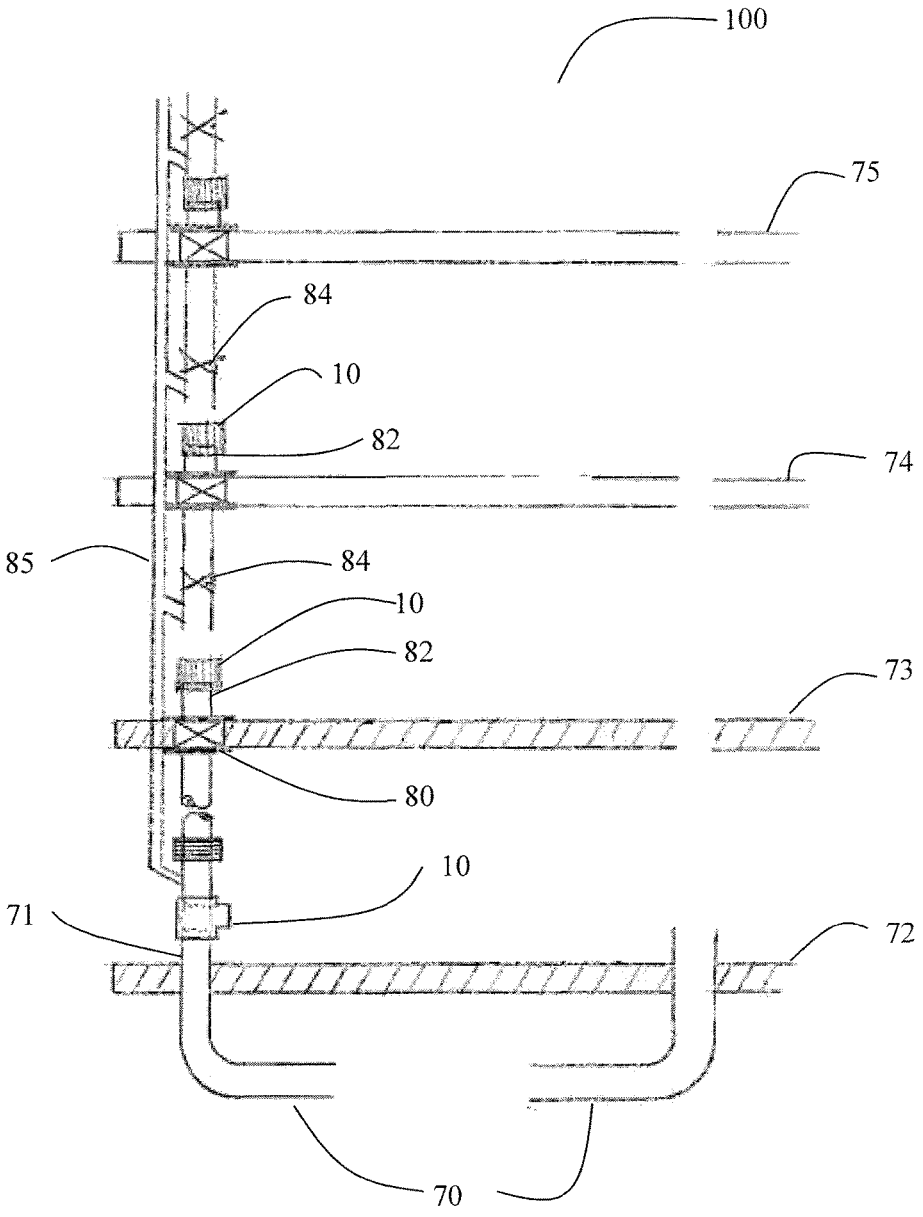
FIG. 7 illustrates the use of debris traps according to FIG. 1 during the construction of a multi-story building.

Referring to FIG. 7, use of debris traps 10 according to FIG. 1 will be explained with reference to construction of a multi-story building 100:

1. Trenches are dug into the ground to place the pipes 70 that connect to all the waste pipes in the structure.
2. The floor formwork is then constructed above.
3. A riser 71 (PVC pipe sized according to the specifications) is placed through the formwork rising approximately 450 mm from the floor.
4. The floor 72 is poured and cured.
5. A debris trap 10 is fixed to the riser 71.

6. Timber formwork is constructed for more floors, (73-74), and a fire collar 80 is installed into the formwork where the pipes are to go through the new floors and the concrete is poured; incorporating the fire collar 80 (cast into the concrete).
7. A butt piece 82 is placed into each collar and a debris trap 10 is fixed in place.
8. Additional pipe is attached to the DWV Boss Junction/Inspection Tee and Fire Collar between each floor which has a junction 84 for bathroom and kitchen, etc, and a vent line 85 is connected to prevent water suction by allowing air into the line.
9. This process is repeated up the floors 75 etc and to all units/apartments.
10. Rubbish/debris can enter the pipes from all openings throughout the building site and it will be prevented from entering the pipes 70 by the grates 30 provided in each debris trap 10.
11. Near to the end of the construction process, the grates 30 are removed from the debris traps. The inspection covers with transparent portions may be replaced with solid opaque caps.

Grate 30 may be used with a housing in the form of a conventional pipe DWV Boss Junction/Inspection Tee. However, in this case there is no fluid bypass pathway.

A second embodiment of a debris trap will now be described with reference to FIGS. 8 to 10 which utilises a conventional pipe DWV Boss Junction/Inspection Tee with a modified form of grate whereby a fluid bypass pathway is provided. In the following description identical features to those seen in the first embodiment are denoted with the same reference numerals.

Figure 8:
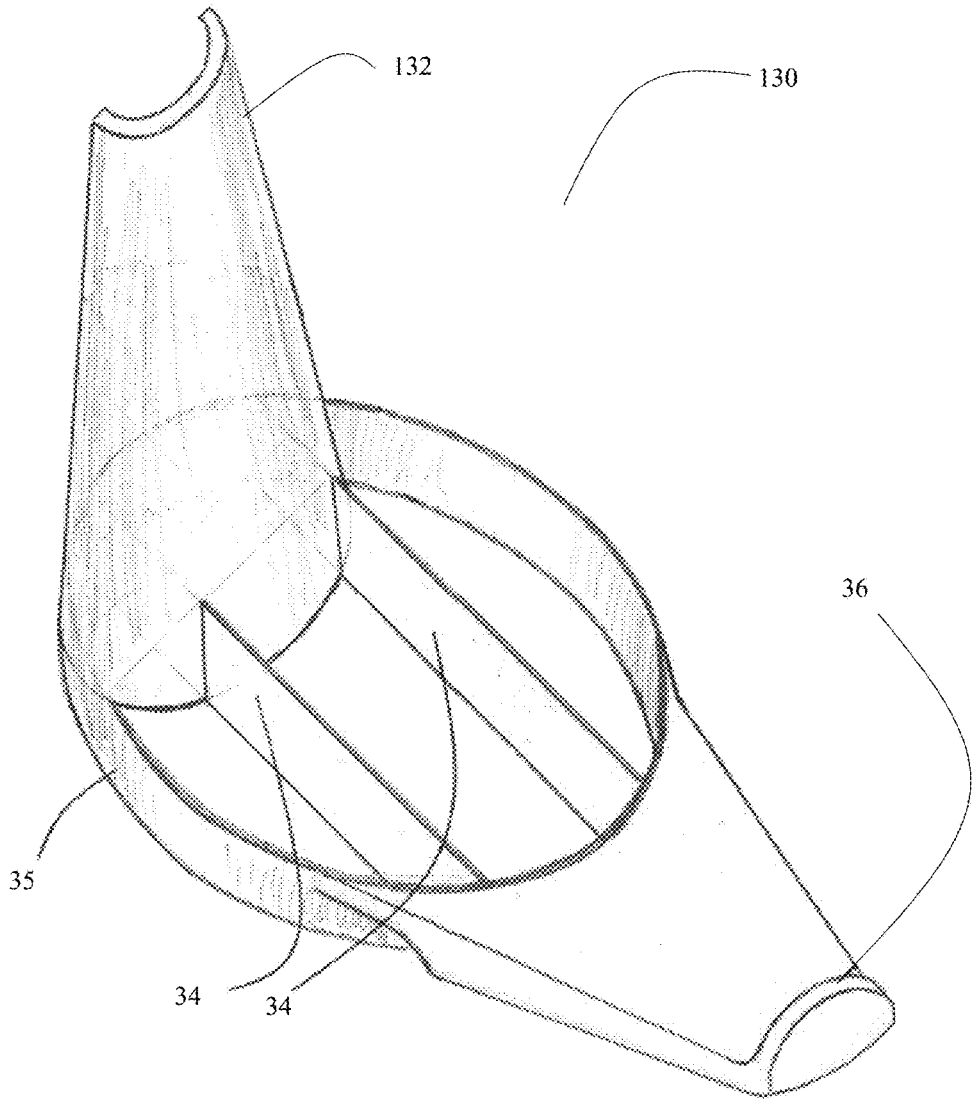
FIG. 8 shows an alternative embodiment of a grate.

Referring to FIG. 8, a second embodiment of a grate 130 is shown which is intended for use with a housing 120 in the form of a conventional pipe DWV Boss junction/Inspection Tee. Grate 130 differs to grate 30 by the provision of an upstanding stem 132. Grate 130 is formed by moulding in one piece. Stem 132 is hollow and acts as a fluid bypass which allows water to flow through the trap when the grate 130 has clogged with debris.

Figure 9:
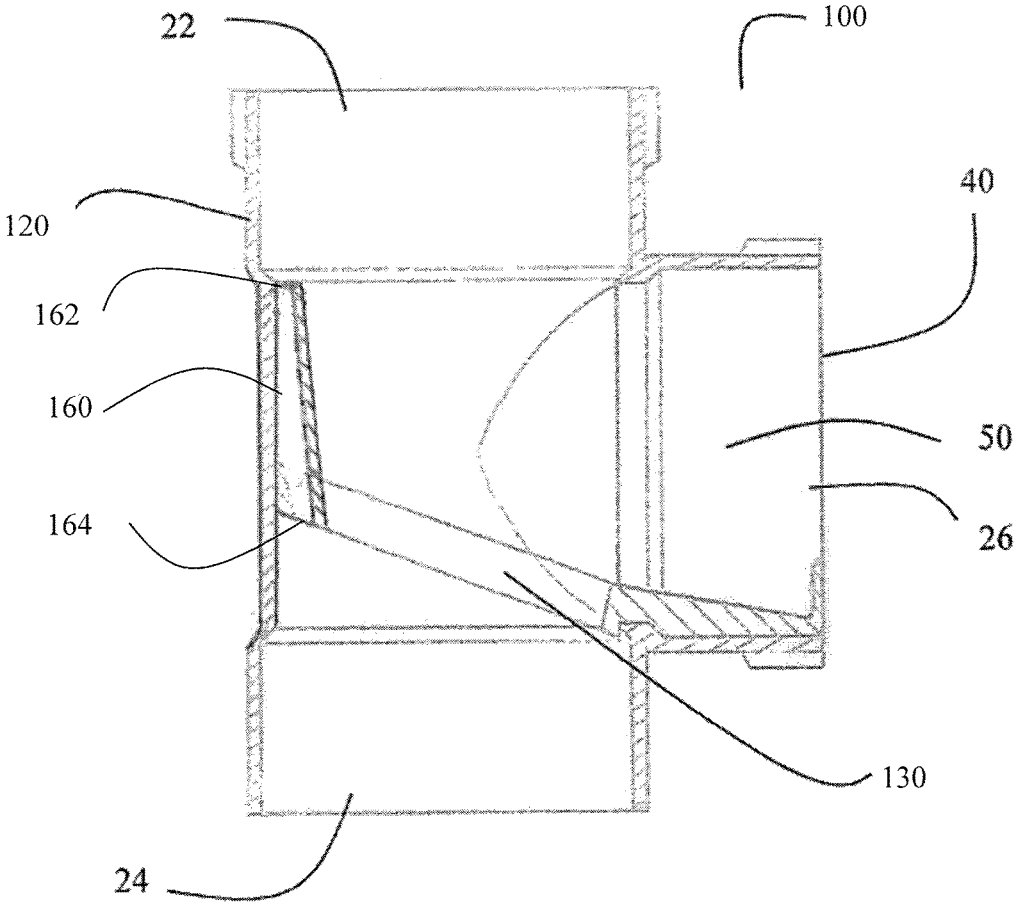
FIG. 9 is a cross sectional view of a debris trap incorporating the grate of FIG. 8.
Figure 10:
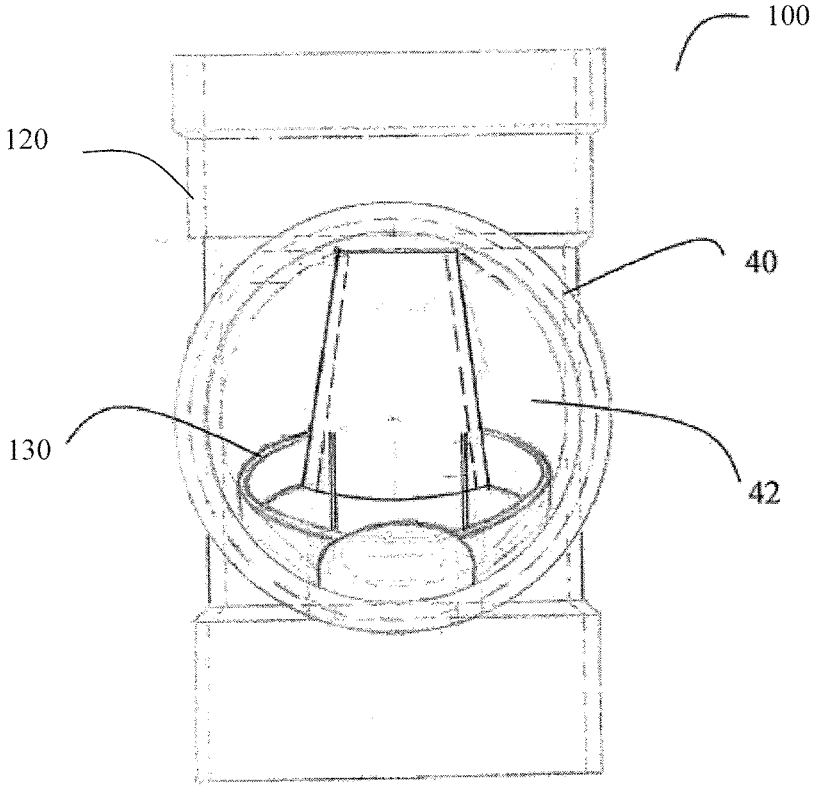
FIG. 10 is a front view of the debris trap of FIG. 9.

Referring to FIGS. 9 and 10, a debris trap 100 is shown which comprises a housing 120 in the form of a conventional pipe DWV Boss Junction/Inspection Tee and grate 130. An inspection cover 40 with a transparent portion 42 retains the grate 130 inside housing 120 in the same manner as for the first described embodiment.

As best seen in FIG. 9, the edges of stem 132 are flush with the inside surface of housing 120 and cooperate with the housing to form a fluid bypass pathway 160 which includes an inlet 162 located above the bars 34 of grate 130 and an outlet 164 located below the bars 34 of grate 130. The fluid bypass pathway 160 allows fluid to bypass the grate 30 in the event that the grate becomes completely blocked with debris.

In all other respects the debris trap 100 operates in the same manner as debris trap 10. Its main advantage is that is shows use of a conventional pipe DWV Boss Junction/Inspection Tee whilst still providing a fluid bypass pathway.

Embodiments of the invention have application to both stormwater and wastewater pipes.

Components of the debris trap may be formed by injection moulding from PVC or similar plastics.

The grate described above included two bars and three apertures. The number of bars and apertures and the shape and size of the apertures may be varied in other embodiments.

Different embodiments of the invention can be sized to suit pipe installations of various diameters.

It can be seen that embodiments of the invention have at least one of the following advantages:

Debris is prevented from travelling down pipework to create blockages which can cause flooding and necessitate unblocking/repair of pipe installations.

The presence of debris can be easily determined by a visual inspection.

Any reference to prior art contained herein is not to be taken as an admission that the information is common general knowledge, unless otherwise indicated.

Finally, it is to be appreciated that various alterations or additions may be made to the parts previously described without departing from the spirit or ambit of the present invention.

The invention claimed is:

1. A debris trap including:

a housing, and the housing including an inlet and an outlet and a fluid flow passage extending from the inlet to the outlet;

the housing further including an inspection opening and an inspection cover which is removable to allow access to the fluid flow passage;

a debris trapping device which is arranged to lie across the fluid flow passage; and the debris trapping device may be introduced to, or withdrawn from, the housing through the inspection opening, wherein the debris trap includes a fluid bypass pathway having a fluid bypass pathway inlet and a fluid bypass pathway outlet which allows fluid to bypass the debris trapping device;

the debris trapping device defines at least a portion of the fluid bypass pathway; and the debris trapping device includes a stem which cooperates with the housing to define the fluid bypass pathway;

the fluid bypass pathway is defined, along an entire length thereof from the fluid bypass pathway inlet to the fluid bypass pathway outlet, by both the stem of the debris trapping device and an inwardly facing surface of the housing; and a transverse cross sectional area of the fluid bypass pathway progressively increases in size from the fluid bypass pathway inlet to the fluid bypass pathway outlet.

2. The debris trap according to claim 1, wherein the inspection cover includes a transparent portion.

3. The debris trap according to claim 1, wherein the debris trapping device includes a handle portion.

4. The debris trap according to claim 3, wherein the handle portion locates against an inner face of the inspection cover.

5. The debris trap according to claim 1, wherein there is a space in a region of the inspection cover and the debris trapping portion is angled to guide trapped debris into the space.

6. The debris trap according to claim 1, wherein the debris trapping device is retained in position in the housing by a recess of the debris trapping device which engages with a lip of the housing.

7. The debris trap according to claim 1, wherein the stem which is hollow and allows water to flow through the debris trap when a grate of the debris trapping device becomes clogged with debris.

8. The debris trap according to claim 1, wherein the debris trapping device is inclined with respect to the fluid bypass pathway so as to deflect debris toward the inspection opening.

9. The debris trap according to claim 1, wherein the stem which projects upstream toward the inlet and a handle which projects toward the inspection opening, and the stem is hollow and allows water to flow through the debris trap when a grate of the debris trapping device becomes clogged with debris while the handle facilitates removal of the debris trapping device from the housing.

10. The debris trap according to claim 1, wherein two longitudinal edges of the stem are flush with the inside surface of housing and cooperate with the housing to form the fluid bypass pathway.

* * * * *